United States Patent [19]

Simon

[11] 3,939,230

[45] Feb. 17, 1976

[54] CARBURETORS

[75] Inventor: Arpad Simon, Nova Iquacu City, Brazil

[73] Assignee: Atom Auto Pecas Ltd., Nova Iquacu City, Brazil

[22] Filed: Dec. 7, 1971

[21] Appl. No.: 205,611

[30] Foreign Application Priority Data

Jan. 18, 1971 Brazil ..... 320

[52] U.S. Cl... 261/50 A; 261/DIG. 58; 261/DIG. 39

[51] Int. Cl.[2] ..... F02M 9/08

[58] Field of Search..... 261/DIG. 58, 62, 50 A, 261/DIG. 39

[56] References Cited

UNITED STATES PATENTS

| | | | |
|---|---|---|---|
| 1,154,530 | 9/1915 | Merriam et al. | 261/50 R |
| 1,172,388 | 2/1916 | Prescott | 261/62 |
| 1,225,466 | 5/1917 | Merriam | 261/41 A |
| 1,412,000 | 4/1922 | Hawxhurst, Jr. et al. | 261/50 A |
| 1,818,068 | 8/1931 | Kreher | 261/DIG. 39 |
| 1,846,789 | 2/1932 | Bush et al. | 261/62 |
| 1,927,302 | 9/1933 | Armstrong | 261/62 |
| 2,574,670 | 11/1951 | Sweeney | 261/50 A |
| 3,069,146 | 12/1962 | MacNeill | 261/62 |
| 3,336,912 | 8/1967 | Morris | 261/50 R |
| 3,342,464 | 9/1967 | Mick | 261/50 A |

*Primary Examiner*—Tim R. Miles

*Attorney, Agent, or Firm*—Browdy and Neimark

[57] ABSTRACT

This invention discloses improvements in carburetors for internal combustion engines, so as to allow a change in the carburetor throat (venturi choke) in proportion to the admission of the gasoline-air mixture, with no change involved in the jet spray nozzle. In this manner, carburetors can be adapted to an extensive power range of gas engines. This variation is obtained through two cylindrical orthogonal sections, oppositely disposed at their curved sections and are centrally recessed, in such a manner that, while rotating or pivoting one against the other they will form a chamber with a central circular passage of a variable diameter, the largest being made up by the opposition of two of the edges and the smallest by the opposition of the two other edges.

1 Claim, 12 Drawing Figures

INVENTOR
Arpad Simon
BY Browdy and Neimark
ATTORNEYS

INVENTOR
Arpad Simon
BY Browdy and Neimark
ATTORNEYS

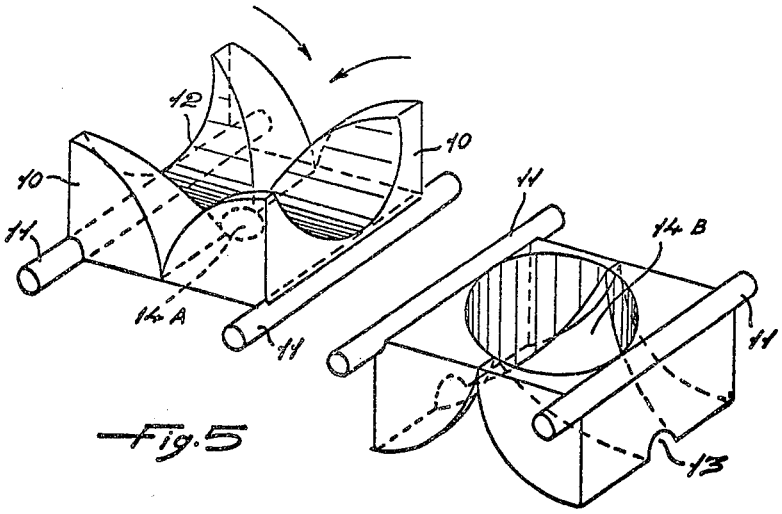
Fig. 5
Fig. 6
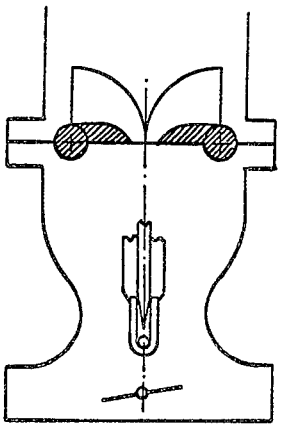
Fig. 7
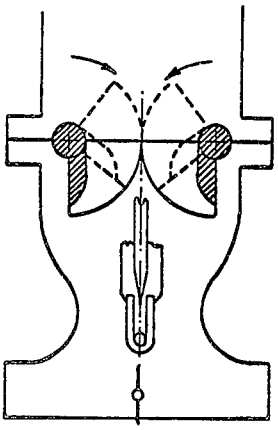
Fig. 8
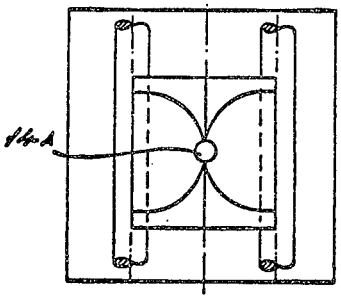
Fig. 7 A
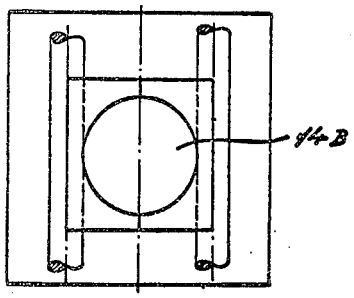
Fig. 8 A
INVENTOR
Arpad Simon
BY Browdy and Neimark
ATTORNEYS INVENTOR
Arpad Simon
BY Brovedy and Reimark
ATTORNEYS

CARBURETORS

This invention relates to improvements in carburetors for internal combustion engines consisting of a venturi choke having a variable throat diameter with a single fuel supply device having an automatically variable fuel inlet area as a function of the depression at the inlet chamber.

In conventional carburetors the venturi choke has an unchanging diameter while the air passing therethrough has a variable speed. By increasing the air speed, the amount of gasoline admitted is also increased, as a function of the fuel jet spray nozzle opening, however, air and gas rates do not remain constant. However, as it is well known, it is of the utmost convenience to keep both rates constant as far as possible for all r.p.m. rates of the engine. To obviate this inconvenience, present carburetors resort to a serial of jet spray nozzles acting simultaneously or sequentially, as well as to accelerating pumps, auto-starters and other means.

In the new type of venturi choke with a variable throat diameter the air speed over the fuel inlet is kept always constant, the amount of gas drawn depending only on the diameter of the feeder bore, which controls and pulverizes the amount of gasoline through the use of a tapered needle acting in conjunction with the displacement of a variable venturi choke.

With the new venturi choke as provided by this invention, with a single variable vaporizer, operating in conjunction with and exclusively as a function of the depression created by the engine, a proper fuel supply is secured at any r.p.m. rates of the engine. By the use of this improved device, the well-known problems involved in manufacture, maintenance and adjustment are reduced and the poisonous gases from the exhaust pipe, with a more complete combustion at the cylinders, are almost fully eliminated.

Heretofore, all known carburetors have been constructed with their components dimensioned according to the type of engine in which they are to be employed, while this invention provides a new type of a self-adjustable venturi choke and feed nozzle for a variety of gas engines with different cylinder capacities and power strokes, just by modifying the diameter of the throttle valve and of the needle.

It is to be emphasized that other solutions for actuation by the inlet chamber depression have been previously proposed for some types of carburetors, however, these differ in construction from that now proposed and claimed.

For a more clear comprehension of the invention it will now be described in detail in conjunction with the attached drawings, in which:

FIG. 5 shows the two cylindrical sector blocks assembly pivotally mounted on shafts, forming the variable feed nozzle, in a closed position;

FIG. 6 shows the same blocks in a position providing the largest section opening of the venturi choke;

FIG. 7 is a schematic sectional view of the carburetor with the venturi choke closed and the feeder needle closed;

FIG. 7A is a top plan view of the same venturi choke;

FIG. 8 shows the venturi choke and the feeder needle fully opened;

FIG. 8A is a top plan view of the venturi choke in the position providing the largest opening;

Figure 1:
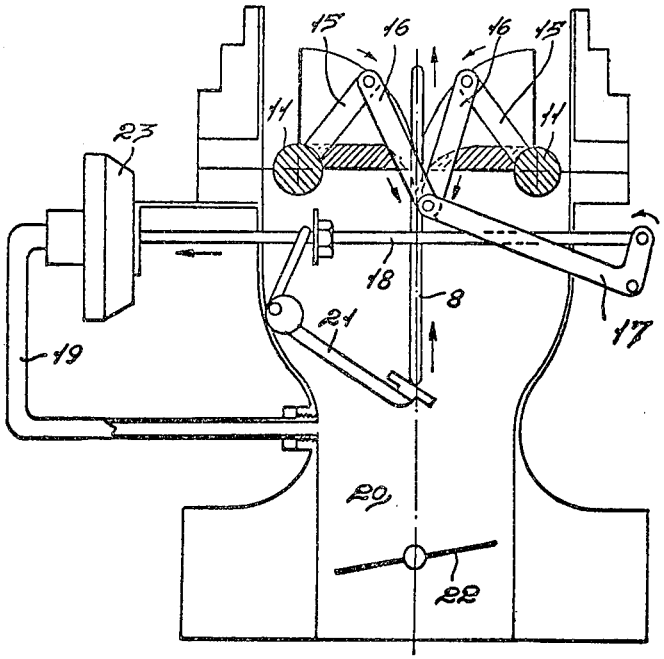
FIG. 1 is a schematic elevation view of the carburetor with the variable feed nozzle closed and the leverage system in an idling speed position.
Figure 2:
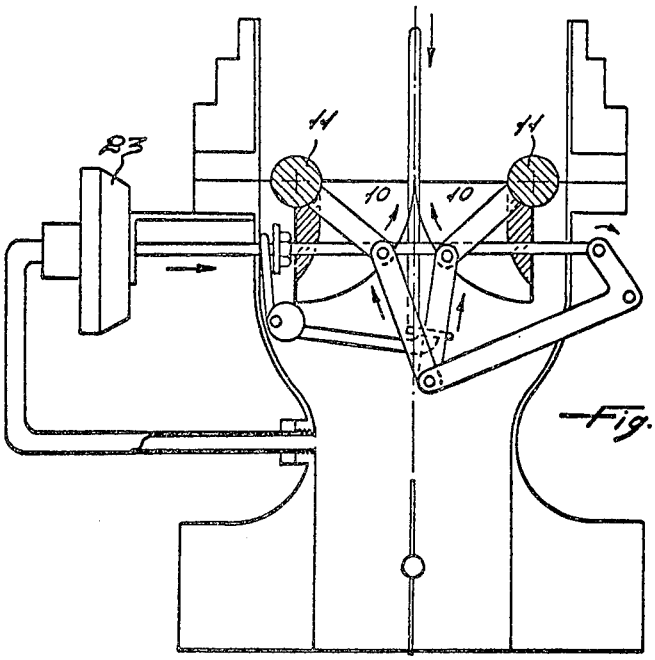
FIG. 2 shows the same carburetor of FIG. 1 with the feed nozzle fully open.
Figure 3:
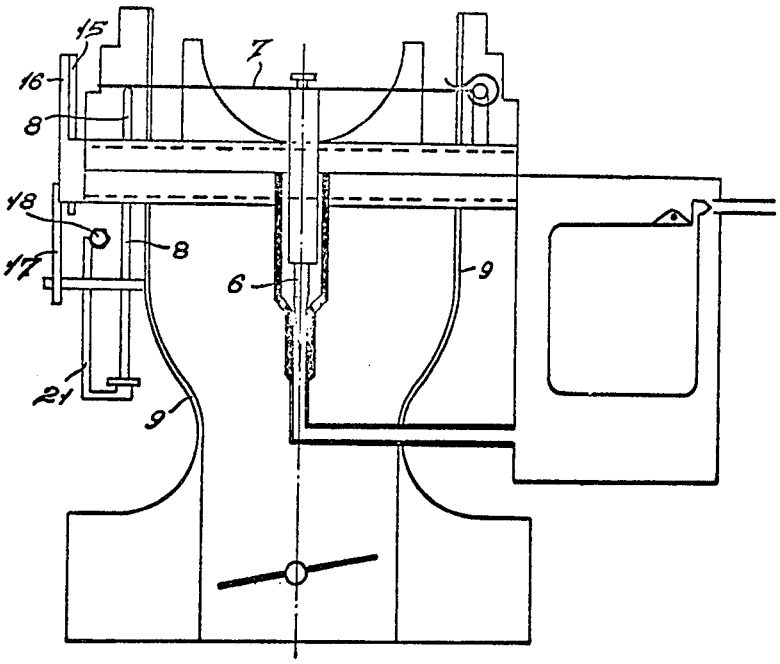
FIG. 3 is a schematic sectional view of the carburetor, showing the constant level float chamber with the fuel controlling tapered needle lowered in a closed position.
Figure 4:
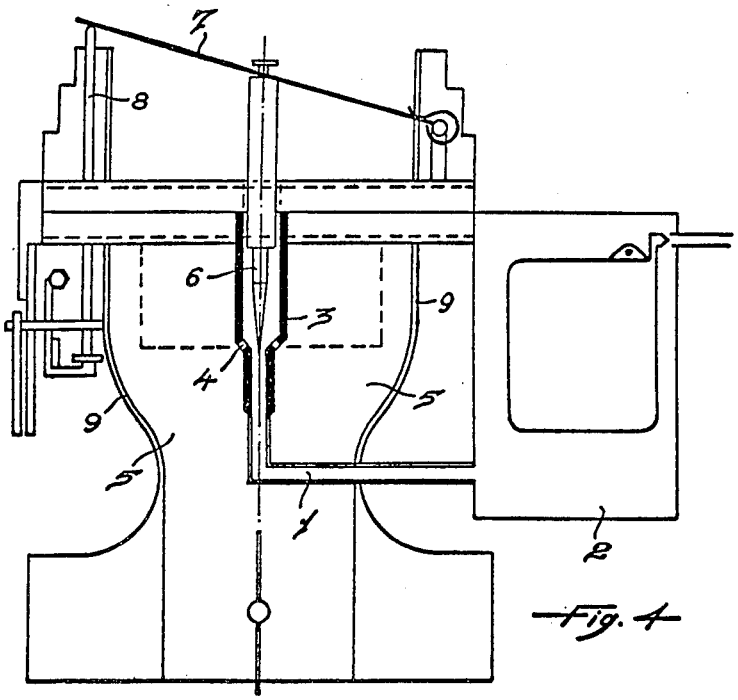
FIG. 4 shows the same carburetor with the tapered needle raised, providing a fully open passage for the fuel through the nozzle outlets.
Figure 9:
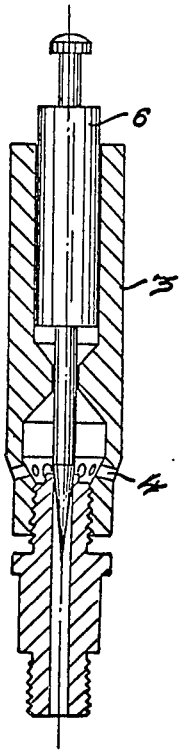
FIG. 9 is a sectional view of the feeder assembled with the tapered needle in a closed position inside the nozzle and showing the vaporizing outlets.
Figure 10:
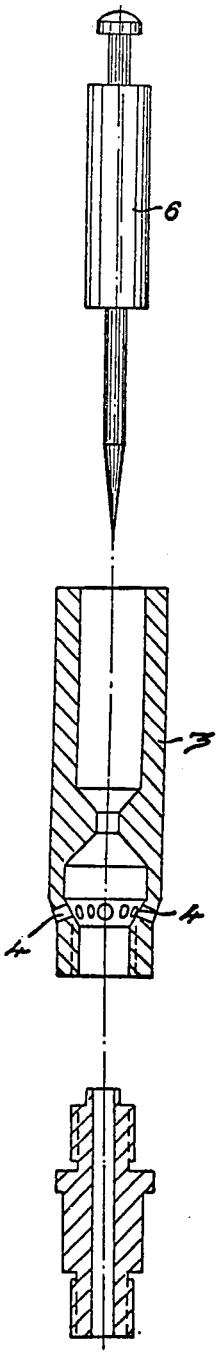
FIG. 10 is an exploded view of the feeder showing the individual components in a longitudinal section.

The improved carburetor of this invention comprises a fuel inlet pipe 1 extending from the constant level float chamber 2, to one end of which is duly fastened the feed nozzle 3, centrally disposed in relation to the body 9; the fuel drawn passes through the spraying outlets 4, mixing with the air in chamber 5, and is directed toward the cylinders through a duct 20, its passage being controlled by a butterfly valve 22.

The amount of fuel that passes through the feed nozzle is regulated by the vertical displacement of a tapered needle 6, linked to a lever 7, subject to the action of a pusher 8, and of a device 21, and yet to a rod 18, that simultaneously operates the variable venturi choke.

The venturi choke is formed by two blocks 10, disposed in the interior of a casing 9, and pivotally mounted on shafts 11, outwardly fastened to the ends of levers 15, linked with 16 and 17, which are simultaneously driven by rods 18, imparting to the respective blocks a 90° rotation.

The simultaneous displacement of the feed nozzle and of the venturi choke is secured through a diaphragm disposed in a chamber 23 which, through a by-pass pipe 19, receives the variations in depression from the fuel inlet pipe 20, pulsating the diaphragm and correspondingly moving the rod 18 fastened to same.

Blocks 10 are formed by a sector of a cylindrical shape having at their curved faces a gradually tapering and curved recess interconnecting the half-circles 12 and 13 in such a manner that, while pivoting around shafts 11, in a ninety degrees travel, with the two curved faces juxtaposed, said recesses form variable circular openings, from a minor diameter 14A, up to a maximum diameter opening 14B, with multiple intermediate openings, providing the necessary variations in the venturi choke. This can be more clearly seen from FIGS. 5 and 7A which show the position of said blocks 10, to provide the minor diameter opening and from FIGS. 6 and 8A which show the position assumed by said blocks 10 to provide the major diameter opening.

In this manner, the engine whole operation is controlled by the pressure over the throttle that will open the butterfly valve 22 in an automatic manner, the increase of the depression will open the variable venturi choke and correspondingly raise the tapered needle providing a larger passage of fuel, maintaining at all times a constant speed of the air and an exact fuel proportioning to form a duly gasified and homogeneous mixture at any rotation rate of the engine, making the latter more elastic, balanced and economic.

The improved carburetor of the present invention has only two adjusting or setting screws, one at the throttle shutter butterfly and the other at the tapered needle for fuel control, thereby extremely simplifying the adjustment and maintenance. It will also be provided with a mechanism connected to the device shown in 21, which will raise the tapered needle, feeding more fuel for starting a cold engine.

What we claim is:

1. In carburators for internal combustion engines comprising two articulate venturi blocks which in combination produce between them a variable aperture, said blocks being mounted in the intake path of the carburator and being combined with a diaphragm control device which actuates a feeding needle valve located inside a feed nozzle connected with a constant level float chamber providing fuel, the improvement wherein said two variable aperture venturi blocks are similarly shaped and are pivotally mounted on two spaced parallel pivoting axes so as to swing inwardly and downwardly and vice-versa, describing an arc of approximately 90 degrees, said venturi blocks being so shaped that a small aperture is formed between them when in their elevated position, said aperture widening as the blocks swing inwards and downwards on account of the particular configuration given to said blocks, said aperture being located directly above said feed nozzle;

wherein said feed nozzle stands vertically and the wall of the lower end of said feeding nozzle tapers downwards and displays around its tapered periphery a plurality of spraying outlets, the bore of said feed nozzle above said tapering lower end being substantially cylindrical, but tapering internally into a narrow passage and tapering out again, thus forming two small chambers, one above and one below said narrow passage, said lower chamber being located immediately above the final lowermost tapering, wherein said plurality of spraying outlets is located; and wherein said feeding needle valve includes a downwardly tapered feeding needle freely mounted in said feed nozzle and a generally cylindrical seat internally mounted in threaded relationship — allowing vertical shifting — on the lower tapered end of said feed nozzle, said feeding needle being capable of abutting the upper end of said cylindrical seat.

* * * * *